United States Patent [19]

Futcher

[11] 4,096,643

[45] Jun. 27, 1978

[54] PAPER WEB STREAK DRYING SYSTEM

[75] Inventor: Ralph James Futcher, Beaconsfield, Canada

[73] Assignee: Dominion Engineering Works Limited, Lachine, Canada

[21] Appl. No.: 759,679

[22] Filed: Jan. 17, 1977

[30] Foreign Application Priority Data

Jan. 21, 1976 Canada ..... 244031

[51] Int. Cl.[2] ..... F26B 11/02

[52] U.S. Cl. ..... 34/122; 34/114; 34/160

[58] Field of Search ..... 34/18, 16, 110–116, 34/160, 122, 123, 148; 165/89, 90

[56] References Cited

U.S. PATENT DOCUMENTS

| | | | |
|---|---|---|---|
| 1,867,256 | 7/1932 | Egli | 34/114 |
| 2,174,744 | 10/1939 | Hill | 34/122 |
| 3,085,347 | 4/1963 | Justus | 34/122 |
| 3,089,252 | 5/1963 | Daane et al. | 34/114 |

*Primary Examiner*—Kenneth W. Sprague
*Assistant Examiner*—James C. Yeung
*Attorney, Agent, or Firm*—Raymond A. Eckersley

[57] ABSTRACT

A moisture profiling apparatus is provided for use with continuous running webs, particularly paper but useful for other permeable webs, having a series of adjacent compartments extending transversely of the web guide means and provided with means to selectively vary the quantity, velocity and temperature of gaseous drying medium impinging on the surface of the web, so as to modify variations in the moisture profile transversely of the web. The profiling hood is generally used in combination with a dryer drum, which may be a hollow drum provided with a plurality of transversely extending vacuum chambers and means to control the vacuum conditions in the drum chambers, so as to further modify the flow conditions of the gaseous drying medium, usually air.

6 Claims, 4 Drawing Figures

PAPER WEB STREAK DRYING SYSTEM

This invention is directed to web drying apparatus for drying a moving continuous web, and in particular to a moisture profiling apparatus particularly suited for modifying variations in the transverse moisture profile of a web such as paper.

In the paper making industry there are a number of good reasons for obtaining the most uniform moisture profile that may be economically achieved.

Existing equipment used for differentially drying newsprint is capable of correcting a variation of about 1% in moisture profile, in a web having a 6% moisture content. This existing profiling capability is somewhat inadequate, and results in the need to exercise undue accuracy of control at the headbox in order to avoid wet streaks that exceed the profiling capability of the paper dryer. Generally speaking, it is often much more satisfactory to control web streak phenomena at the dryer than in the headbox.

One earlier arrangement, shown in U.S. Pat. No. 3,163,503 McKellar et al, Dec. 29, 1964, provides a plurality of adjoining dryer hood segments for the purpose of profile control of moisture content of the web, utilizing a plurality of contiguous dryer units for providing hot air in controlled quantities, by direct impingement against the outer face of the web. The requisite control of moisture profile in the crossmachine direction is achieved by McKellar et al by throttling the hot air supply to the individual units to achieve the desired effect.

In the present invention wherein contiguous dryer hood segments also are used, control of web drying conditions is much more rigorously exercised, by the provision of an individual cold air mixing capability within each hood segment to permit selected temperature gradation at any of the contiguous dryer segment units. This provision of temperature control by air blending makes possible the maintenance of substantially uniform air pressure acting on the web, so as to make it possible to limit the tendency for cross-machine flows between dryer unit sections or segments.

Air flow control is enhanced in the present invention by the provision of comprehensive air inlet and air outlet flow controls for each section.

In addition to impingement drying, the presently disclosed apparatus also combines percolation drying, by the provision of a suction dryer drum. To provide control of the degree of percolation drying, in order to permit differentiation in the cross-machine direction a suction box within the dryer drum is compartmentalized in substantial coincidence with the dryer hood sections, so as to provide a further degree of control over the pressure drop acting across the thickness of the web.

In accordance with the present invention there is provided a web drying apparatus for use in providing selectively differentiated drying across the face of a longitudinally moving web, comprising a dryer drum rotatably mounted to receive thereon a web in drying relation; a plurality of hood compartments to provide gas impingement zones extending transversely relative to the drum periphery in mutually contiguous relation; hot gas supply means connected to at least some of the hood compartments; cold gas supply means connected to at least some of the same hood compartments, and selectively variable gas flow control means to provide gas in differentiated drying relation across the face of the web, whereby in operation the variance in moisture profile across the web face may be diminished.

This invention further provides a method of modifying the transverse moisture profile of a wide travelling web, including the steps of impinging a high velocity jet of gaseous drying agent against one face of the web, and effecting variation of the condition of a selected area portion of the gaseous flow to locally modify the drying effect thereof whereby selective zone drying of the web is effected.

The practice of the invention is facilitated by the provision of controllably variable suction compartments within the drum in substantial transverse coincidence with the hood compartments, to provide local control of gaseous flow rates through the web.

In order to permit quantitative and qualitative control of the gas impinging on the web at least some of the hood compartments are provided with an individually selectively variable supply of hot gas and a like supply of cold gas, whereby the desired differentiation in drying action may be achieved.

Owing to the variation of local temperatures across the width of the dryer hood the expansion of respective ones of the hood compartments can vary.

One contemplated provision to facilitate the functioning of the apparatus is the provision of means to maintain the hood in centered relation relative to the drum ends, with transverse dimensional changes of the hood compartments due to temperature variations taking place cumulatively transversely (axially) outwardly from the centre plane of the drum.

In addition to providing enhanced rates of drying, with a consequently widely extended capability for wet streak control, the present invention makes it possible to control the application of impingement air over the full face of the web. Furthermore, by providing a selectively controllable extent of through drying, there is a tendency to controlling the moisture content of reflected impingement air, as the bulk of moisture generally carries through the web. This reflected impingement air thus has a lower moisture content and is of more value for recirculation through the impingement hood units.

Provision also is made for selectively discarding reflected air, without recycling. Thus, in the case of a hood unit such as the web edge, where it may prove desirable to maintain full impingement air flow for purposes of web stabilization, and to control air flow conditions at the hood edge, while at the same time avoiding any drying effect, it may prove useful to impinge cold air on the web. Thus there may be a significant quantity of cold air being recirculated upwardly within the respective unit, away from the web. By releasing this cold air to the paper room or to stack, the thermal quality of the recirculated air from the adjoining hood units will not be unduly degraded (cooled off), so that economy in heat energy can be effected.

It is anticipated that up to approximately one third of the impingement air may percolate through the web, under conditions of maximum drum suction. This percolating fraction diminishes with reduction in the vacuum applied within the dryer drum. dr Certain embodiments of the invention are described, reference being made to the accompanying drawings, wherein.

Figure 1:
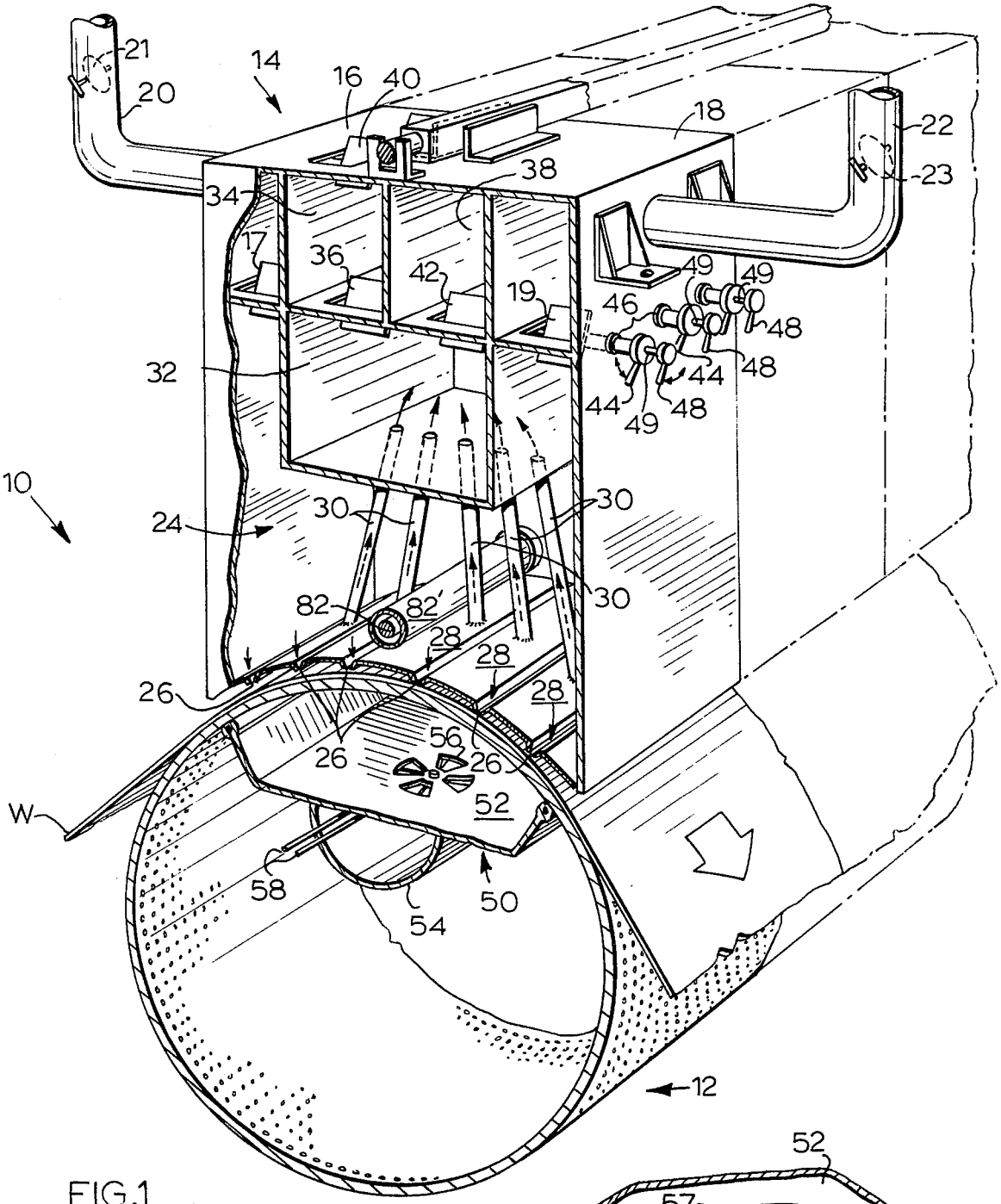
FIG. 1 is a general view, in elevation, of a dryer hood unit and a portion of the dryer drum, with end covers removed from both hood and drum.

Referring first to FIG. 1, this is a somewhat schematic illustration showing the manner in which an element of the subject hood may be arranged, whilst omitting particulars of hood suspension etc. The front end covers of the dryer drum and hood element are omitted.

The dryer arrangement 10 includes a perforated dryer drum 12, only a portion of which is shown, corresponding to the illustrated hood elements which surmount it. A paper web W is guided beneath a dryer hood, of which a section 14 is shown, with two adjoining sections in phantom. A hot air plenum 16 and cold air plenum 18 are located at the top of the hood section 14, each having respective variable control louvres 17, 19.

A hot air conduit 20 and cold air conduit 22 serve to supply several of the interconnected hot and cold hood plenum sections. Slip joints (not shown) serve to interconnect the hot plenum of the sections or units, and to interconnect the cold plenum units. The air supply conduits 20, 22 are each illustrated as having a flow control butterfly valve 21, 23.

A lower portion 24 of the dryer hood section provides a mixing space in which the hot and cold air mix together before passing at high velocity from the section onto the web W, by way of nozzles 26.

A centering shaft 82 is located within a casing 82' to permit control of the length of the shaft by appropriately air conditioning it.

The apron portions 28 from which the nozzles 26 project each have a return flow conduit 30 connecting with a return plenum 32. This return air plenum 32 connects with an isolated discharge plenum 34, by way of adjustable louvres 36, and with a return air trunk 38, by way of adjustable louvres 42.

The discharge plenum 34 has individual ends walls (not shown), providing compartmentalization in the cross machine direction and is provided with discharge louvres 40 in the illustrated embodiment. The return air trunk 38 connects with the adjacent hood section or sections and provides a recirculation air supply to the heating unit of the dryer.

In the illustrated embodiment each control arm 44 serves through rotation of its shaft 46 to position the louvre 19 of the cold air trunk 38 connects with the adjacent hood section or sections and provides a recirculation air supply to the heating unit of the dryer.

In the illustrated embodiment each control arm 44 serves through rotation of its shaft 46 to position the louvre 19 of the cold air supply; and the control arm 48 through its shaft 49 extending through the shaft 46 serves to position the louvre 42 of the return air trunk. A similar coaxial arrangement of control arms and shafts (not shown), serves to control the hot air supply louvres 34 and the return air discharge louvres 36. The louvres are rotated angularly about their respective shafts, as is well known in the art.

Figure 2:
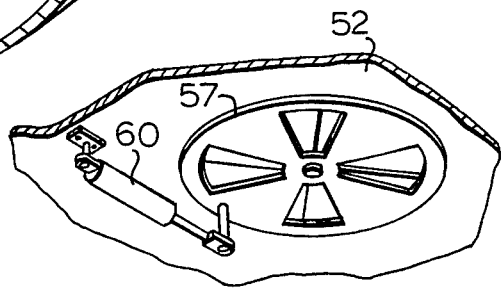
FIG. 2 is a general view (inverted) of a vacuum control valve and actuating mechanism.

Within the holey roll 12 there is provided a suction box 50 compartmented by spaced transverse dividers (not shown), positioned axially of the roll in coincidence in the cross-machine direction with the individual hood sections. Each compartment 52 of the box 50 connects with a vacuum header 54 through an adjustable throttle valve 56 (see FIG. 2), so that the suction applied to each compartment 52 may be selectively controlled by the respective throttle valve 56.

Hydraulic or pneumatic control lines 58 control the setting of individual double acting actuators 60 (see FIG. 2) whereby the setting of each of the valve discs 57 for each vacuum compartment 52 of the suction box may be remotely selected or adjusted.

Figure 3:
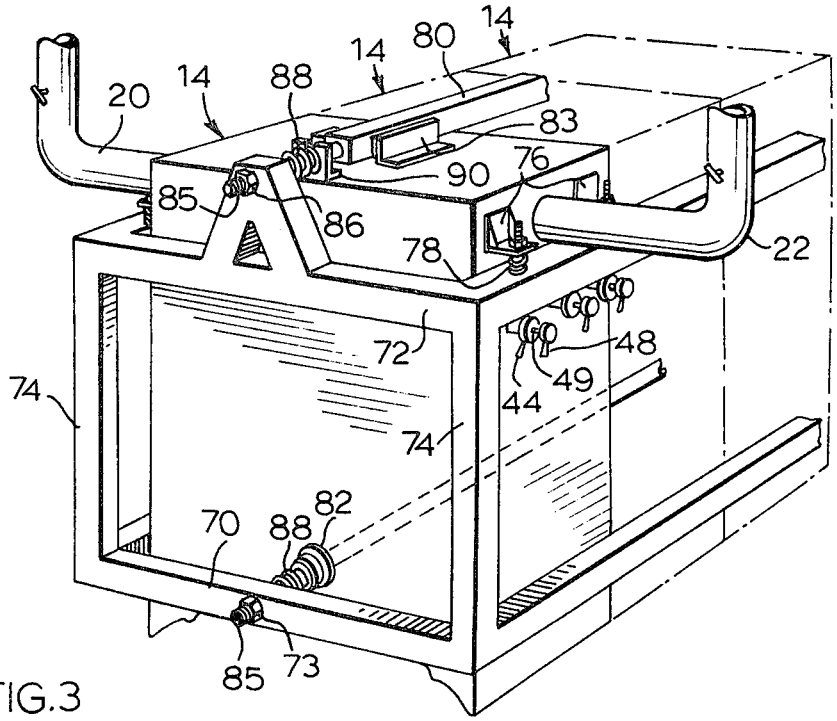
FIG. 3 is a view similar to FIG. 1; showing features of the support frame.
Figure 4:
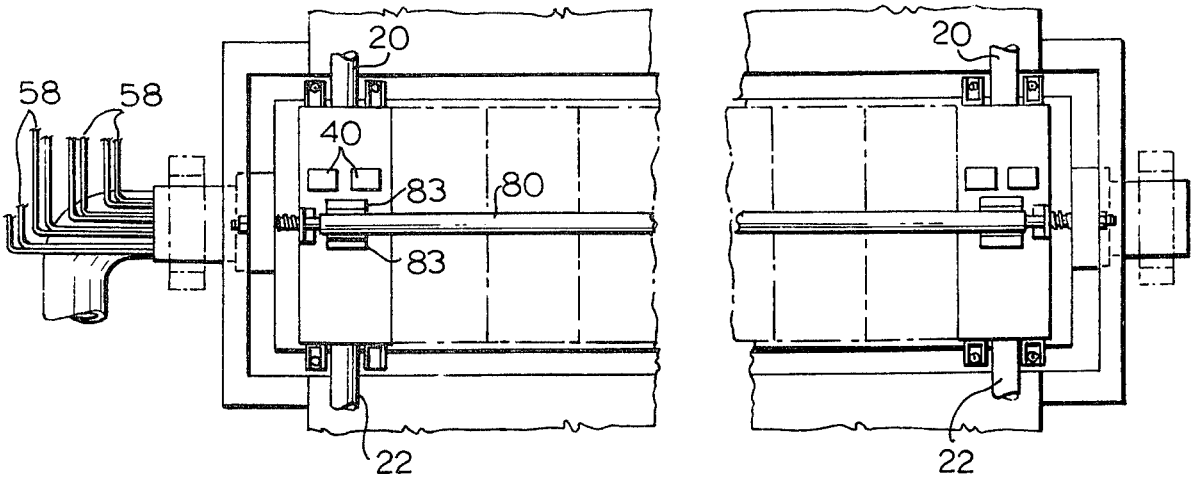
FIG. 4 is a plan view of the embodiment of FIG. 3.

Referring to FIG. 3, the dryer hood comprises a plurality of interconnected hood units 14 supported by transverse frame members 70, 72. A temperature compensated guide 82 serves to locate the centre one of the dryer hood units 14 in substantial alignment with the centre axis of the machine. By virtue of the hood suspension arrangements described below the expansion or contraction of the hood 14 may be arranged to take place about the machine centre line or axis of symmetry.

The three hood sections 14 illustrated are located within a bottom frame 70 and top frame 72, the frames being interconnected by corner struts 74.

Each hood section 14 is spring mounted by opposed brackets 76 and an adjustable compression spring arrangement 78, the downstream side only being visible here.

A top centering beam 80 and a bottom centering shaft 82 are shown, being adjustable secured to the respective top frame 72 and bottom frame 70. A threaded rod portion 85 of beam 84 extends through the side members of the top frame 72 being adjustably connected by way of nut 86, and spring 88 acting against hood abuttment 90. This tends to keep the hood sections 14 in compressed relation towards the machine center line, relative to the frame 72.

Centering pads 83 secured to the top of the hood sections 14 and contacting the sides of the beam 80 in sliding relation therewith maintain the desired orientation of the hood section 14 while preserving the capability for relation expansion and contraction.

The bottom centering shaft 82' is hollow, to permit connection to a source of stabilizing fluid such as air at a predetermined temperature, whereby the length of the shaft 82 may be stabilized by circulation of stabilizing fluid at a desired temperature and flow rate, from a source not shown.

The lower shaft 82 extends between the side members of the bottom frame 70 and has a central one of the hood sections 14 secured thereto at a location low down in the section closely adjacent the respective nozzle plate, so as to afford centering in the cross-machine direction and radial location relative to the surface of the drum 12. The other hood sections 14 are resiliently pressed against the center-positioned section 14 by way of springs 88 acting against the outer end plates of the outermost sections 14.

It will be understood that one end of the shaft 82 may be fixedly located relative to the one side of the frame 70 by use of lock-nuts 73.

The provision of wheels and rails to permit relatively unrestrained thermal displacement of the hood in expanding and contracting also is contemplated.

What I claim as new and desire to secure by Letters Patent of the United States is:

1. Web drying apparatus for use in providing selectively differentiated drying across the face of a web comprising a dryer drum rotatably mounted to receive thereon a web in drying relation; a plurality of hood segments in axial abutting relation to provide adjoining control zones across the width of the web, each hood segment having a plurality of outlet nozzles for the supply of pressurized air inwardly towards the face of the drum, and a plurality of return flow conduits to receive in operation a return flow of air from the web surface; a return plenum having the return flow conduits connected thereto; a hot air conduit; a cold air conduit; a mixing chamber communicating with the outlet nozzles; hot air supply means and cold air supply means respectively connected to the hot air conduit and the cold air conduit; and hot air flow control means and cold air flow control means to regulate air flow and temperature within the mixing chamber, whereby the drying capability of each respective hood segment can be selectively controlled.

2. The apparatus as claimed in claim 1 wherein said return flow conduits are interconnected across the width of the apparatus.

3. Web drying apparatus as claimed in claim 1 wherein said dryer drum includes a permeable outer surface to promote through-flow of gas in drying relation with said web.

4. Apparatus as claimed in claim 3, including vacuum compartment means within said drum to provide at least one zone of reduced pressure about a portion of the inner surface of the drum, and suction control means to control said reduced pressure.

5. Apparatus as claimed in claim 4 including a plurality of axially spaced partition means within said drum to provide a plurality of axially adjacent compartments therein, said suction control means comprising individual suction valves, to provide selective control over the pressure within said drum compartments.

6. Apparatus as claimed in claim 5 wherein the axial boundaries of said plurality of drum compartments are located in substantial correspondence with the axial boundaries of said hood segments for at least one operating condition of the apparatus.

* * * * *